US005283110A

United States Patent [19]

Gardner et al.

[11] Patent Number: 5,283,110

[45] Date of Patent: Feb. 1, 1994

[54] HIGH TEMPERATURE COPOLYESTER MONOFILAMENTS WITH ENHANCED KNOT TENACITY FOR DRYER FABRICS

[75] Inventors: Jennifer A. Gardner, Great Falls; Michelle A. Diaz-Kotti, Columbia, both of S.C.

[73] Assignee: Shakespeare Company, Columbia, S.C.

[21] Appl. No.: 830,841

[22] Filed: Feb. 3, 1992

[51] Int. Cl.[5] ..... C08L 67/02; D03D 1/00; D03D 15/12

[52] U.S. Cl. ..... 428/227; 428/225; 524/513; 525/165; 525/173; 525/174

[58] Field of Search ..... 525/174, 165, 173; 524/513; 428/227, 225

[56] References Cited

U.S. PATENT DOCUMENTS

| | | | |
|---|---|---|---|
| 2,686,180 | 8/1954 | Schmidt et al. | 260/230 |
| 3,723,373 | 3/1973 | Lucas | 525/165 |
| 3,728,287 | 4/1973 | Burmaster | 260/2.3 |
| 3,975,329 | 8/1976 | Barnewall et al. | 260/75 |
| 4,000,239 | 12/1976 | Hamana et al. | 264/176 |
| 4,191,678 | 3/1980 | Smith | 524/371 |
| 4,207,230 | 6/1980 | Bier et al. | 260/45.95 |
| 4,221,703 | 9/1980 | Hoeschele | 260/45.9 |
| 4,284,549 | 8/1981 | Salee | 260/40 |
| 4,600,743 | 7/1986 | Shizuki et al. | 524/377 |
| 4,639,480 | 1/1987 | Birum et al. | 524/104 |
| 4,670,498 | 6/1987 | Furusawa et al. | 524/381 |
| 4,707,506 | 11/1987 | Markezich | 524/89 |
| 4,965,338 | 10/1990 | Tabankia et al. | 528/272 |
| 5,169,499 | 12/1992 | Eagles et al. | 428/175 |

FOREIGN PATENT DOCUMENTS

WO90/12918 11/1990 PCT Int'l Appl. .

OTHER PUBLICATIONS

"Kodar ® Thermx TM Copolyester for Dual Ovenable Trays", *Eastman Plastics*, Dec. 1987.

"Physical Property Data Sheet", *Eastman Plastics*, Jan. 1990.

"Tentative Data Developmental PCTA Copolyester 6761", *Eastman Plastics*, Oct. 1986.

"Material Safety Data Sheet", *Eastman Chemical Products, Inc.*, Kodar ® Thermx TM, Sep. 1990.

*Primary Examiner*—Patricia A. Short

*Attorney, Agent, or Firm*—Renner, Kenner, Greive, Bobak, Taylor & Weber

[57] ABSTRACT

A high temperature copolyester monofilament exhibits enhanced knot tenacity and is formed from the extrusion of a polymer blend of a copolyester resin and a fluoropolymer resin. Additives such as thermal stabilizers may be added to the polymer blend. The polymer blend may be extruded in the presence of other additives such as a hydrolytic stabilizer. The monofilament exhibits a higher average knot tenacity, a higher minimum knot tenacity, a narrower knot tenacity range and lower standard deviation as compared to standard high temperature copolyester monofilaments. A dryer fabric comprises a plurality of woven copolyester monofilaments having enhanced knot tenacity, the monofilaments comprising a polymer blend of copolyester resin and fluoropolymer resin, and may further include thermal stabilizers and hydrolytic stabilizers.

16 Claims, No Drawings

HIGH TEMPERATURE COPOLYESTER MONOFILAMENTS WITH ENHANCED KNOT TENACITY FOR DRYER FABRICS

TECHNICAL FIELD

The subject invention relates to a high temperature copolyester monofilament such as may be useful as a component of paper machine dryer fabrics. More particularly, the invention relates to a high temperature copolyester monofilament having enhanced knot tenacity as compared to standard high temperature copolyester monofilaments. Specifically, the invention relates to a high temperature copolyester monofilament produced from a polymer blend of a fluoropolymer resin and a high temperature copolyester resin.

BACKGROUND OF THE INVENTION

High temperature copolyester monofilaments are known in the art. Examples of such copolyester monofilaments are disclosed in PCT International Patent Application No. WO 90/12918. These monofilaments differ from conventional high molecular weight polyester monofilaments in that they exhibit substantially different physical properties. For example, a high temperature copolyester monofilament extruded from a copolyester resin and produced by Shakespeare Monofilament of Columbia, S.C., has a melt point of 285° C. as compared to a conventional high molecular weight polyester monofilament, produced by the same company, which has a melt point of 260° C. The high temperature copolyester monofilament is advantageous in its use in that it exhibits improved resistance to hydrolytic degradation which makes this monofilament more suitable for use in dryer fabrics.

However, an undesirable property associated with the standard high temperature copolyester monofilament is that it exhibits a substantially lower knot tenacity as compared to the conventional high molecular weight polyester monofilament. As noted at page 6 of the bulletin "High Temperature Monofilaments Comparison" furnished by Shakespeare Monofilament of Columbia, S.C., WP-550, a conventional high molecular weight polyester monofilament produced from a 0.95 I.V. polyethylene terephthalate (PET) resin, exhibits an average knot tenacity of 3.5 grams per denier (gpd) as compared to HPP-50, a standard high temperature copolyester monofilament, which exhibits an average knot tenacity of only 1.8 gpd.

Thus, a need exists for a high temperature copolyester monofilament having improved knot strength and enhanced knot tenacity.

SUMMARY OF INVENTION

It is therefore, a primary object of the present invention to provide a high temperature copolyester monofilament having a higher average knot tenacity, a higher minimum knot tenacity, a narrower knot tenacity range and a lower standard deviation as compared to standard high temperature copolyester monofilaments.

It is another object of the present invention to provide a high temperature copolyester monofilament formed with or without the use of a thermal stabilizer and with or without the use of a hydrolytic stabilizer.

It is still another object of the present invention to provide a high temperature copolyester monofilament which exhibits improved resistance to soiling and surface contamination.

It is a further object of the present invention to provide a paper machine dryer fabric formed from a plurality of high temperature copolyester monofilaments having enhanced knot and higher knot tenacity.

At least one of more of the foregoing objects of the present invention, together with the advantages thereof over existing monofilaments and products thereof, which shall become apparent from the specification which follows, are accomplished by the invention as hereinafter described and claimed.

In general, a high temperature copolyester monofilament which exhibits an enhanced knot tenacity according to the present invention is extruded from a polymer blend, in the presence of from 0 to about 5 percent by weight of a hydrolytic stabilizer, the polymer blend comprising from about 99 to about 75 percent by weight of a high temperature copolyester resin, from about 1 to about 25 percent by weight of a fluoropolymer resin to form 100 percent by weight of the blend, and from about 0 to about 10 percent by weight of a thermal stabilizer, with an appropriate reduction of at least one of the polymer components.

The present invention also provides a paper machine dryer fabric which comprises a plurality of woven copolyester monofilaments having enhanced knot tenacity, comprising a polymer blend, extruded in the presence of 0 to about 5 percent by weight of a hydrolytic stabilizer, the polymer blend, in turn, comprising from about 99 to about 75 percent by weight of a high temperature copolyester resin, from about 1 to about 25 percent by weight of a fluoropolymer resin to form 100 percent by weight of the blend, and from 0 to about 10 percent by weight of a thermal stabilizer, with an appropriate reduction of at least one of the polymer components.

PREFERRED EMBODIMENT FOR CARRYING OUT THE INVENTION

The present invention is directed toward a high temperature copolyester monofilament. The monofilament has a higher average knot tenacity, a higher minimum knot tenacity, a narrower knot tenacity range and a lower standard deviation as compared to standard high temperature copolyester monofilament. Moreover, the monofilament maintains an improved resistance to hydrolytic degradation as found with standard high temperature copolyester monofilament when compared to conventional high molecular weight polyester monofilament. Furthermore, it is believed that the monofilament exhibits an improved resistance to soiling and surface contamination. The monofilament may be formed with or without additives such as hydrolytic or dry heat stabilizers.

The monofilament is extruded from a polymer blend of copolyester resin and a melt extrudable fluoropolymer resin. The copolyester resin is generally formed by the reaction of a bifunctional acid with a bifunctional alcohol. The bifunctional acid is preferably terephthalic or isophthalic acid, and the bifunctional alcohol is preferably ethylene glycol or cyclohexanedimethanol.

An example of a copolyester resin useful in the present invention is a copolymer comprised of terephthalic acid, 1,4-dimethylolcyclohexane and isophthalic acid, which produced by the Eastman Kodak Company under the trade name KODAR THERMX Copolyester 13319. KODAR is a registered trademark of the Eastman Kodak Company for a thermoplastic copolyester resin. The copolyester is often used for "dual ovenable", i.e. microwave or conventional oven, food trays. It is thermoformed into the desired tray shape, and exhibits an increased resistance to thermal and hydrolytic degradation. This same copolyester resin is designated as KODAR THERMX Copolyester 6761 in PCT International Patent Application No. WO 90/12918 as poly(1,4-cyclohexandicarbinyl terephthalate).

Fluoropolymer resins useful in the present invention are melt extrudable and may include copolymers of ethylene and halogenated ethylene. Examples of such halogenated ethylenes include tetrafluoroethylene, wherein the halogenating agent is fluorine, and chlorotrifluoroethylene, wherein the halogenating agents are chlorine and fluorine.

Examples of fluoropolymer resins useful in the present invention are those produced by E. I. du Pont de Nemours & Co. and Ausimont USA, Inc. under the trade names TEFZEL 210 and HALAR 500, respectively. TEFZEL is a registered trademark of E.I. du Pont de Nemours & Co., Inc. for a fluoropolymer resin, namely a melt processible copolymer of ethylene and tetrafluoroethylene, and HALAR is a registered trademark of Ausimont USA, Inc. for a similar fluoropolymer resin, namely a copolymer of ethylene and chlorotrifluoroethylene. Both fluoropolymer resins are suitable compositions for extrusion purposes, and further are preferred for the polymer blend.

It should be understood that any copolyester resin and melt extrudable fluoropolymer resin suitable for the functional requirements described herein may be used in the present invention, and any examples provided herein are not intended to limit the present invention to those particular resins or to those particular amounts, unless otherwise indicated.

About 1 to about 25 percent by weight, and preferably, about 5 to about 15 percent by weight of the desired fluoropolymer resin is blended with a complementary amount of the copolyester resin to form 100 percent by weight of the polymer blend. Additives for thermal or dry heat stability may also be blended with the copolyester resin and fluoropolymer resin. Preferably, from 0 to about 10 percent by weight of such an additive may be substituted for a lesser percent by weight of the copolyester resin or the fluoropolymer resin or combination thereof.

Examples of such suitable thermal or dry heat stabilizers include antioxidants such as THERMX 13319-L0001, a proprietary chemical structure compounded with the KODAK THERMX Copolyester 13319 resin, produced by Eastman Chemical Products, Inc., and Irganox 1330, a hindered phenol produced by Ciba Geigy, Inc.

The polymer blend may then be extruded, preferably by a process of melt extrusion, to produce the high temperature copolyester monofilaments of the present invention. Preferably, the monofilament comprises 100 to about 95 percent by weight of the polymer blend. Accordingly, the polymer blend may be extruded in the presence of 0 to about 5 percent by weight of a stabilizing agent for hydrolytic stability. Most stabilizing agents which aid hydrolytic stability are carbodiimides. Examples of such hydrolytic stabilizers which include carbodiimide are Stabaxol 1, Stabaxol P and Stabaxol P100, each being produced by Rhein-Chemie. Such compounds are 2,2',6,6'-tetraisopropyldiphenyl carbodiimide or benezene-2,4-diisocyanato-1,3,5-tris(1-methylethyl) homopolymer or a copolymer of 2,4-diisocyanato-1,3,5-tris(1-methylethyl) with 2,6-diisopropyldiisocyanate, respectively, or the like.

During extrusion, the hydrolytic stabilizer can be added at a rate based upon the pounds of monofilament extruded per hour. This can be accomplished by a melt addition, a dry concentrate or a powder addition system as is known to those skilled in the art. An alternative method is to dry blend or batch blend all additives and polymers as is also known to those skilled in the art. Hence, irrespective of the means of addition, the monofilament of the present invention is extruded in the presence of a hydrolytic stabilizer, when one is desired.

High temperature copolyester monofilaments prepared according to the present invention have utility in the production of products such as paper machine dryer fabrics. A plurality of these monofilaments can be interwoven as is commonly known in the art. Such fabrics produced from these monofilaments exhibit improved weavability which provides greater design flexibility and more dimensionally stable fabrics while maintaining an increased resistance to hydrolytic degradation, which are useful properties for dryer fabrics or belts.

MONOFILAMENT EXAMPLES

In order to demonstrate practice of the present invention, tests for knot tenacity, were performed on two monofilaments prepared according to the present invention and compared to the average, minimum and maximum knot tenacity of a standard high temperature copolyester monofilament having the same diameter as those monofilaments tested.

The standard high temperature copolyester monofilament is formed from a blend of KODAR THERMX copolyester resin and 2.5 percent by weight of THERMX 13319-L0001, a thermal stabilizer, and has known values for knot tenacity which are reported in Table I. The monofilaments according to the present invention were each prepared and extruded by a similar process as was used for determining the knot tenacity of the standard high temperature copolyester monofilament, and thus, this standard monofilament will be considered the control monofilament for the present invention. The knot tenacity was determined by the ASTM Test method D3217.

Monofilament 1, according to the present invention, was prepared from a polymer blend of the KODAR THERMX copolyester resin and 5 percent by weight of the fluoropolymer resin, TEFZEL 210. The blend also included 2.5 percent of the thermal stabilizer, THERMX 13319-L0001. Monofilament 2 was prepared from a similar polymer blend, except 5 percent by weight of the fluoropolymer resin, HALAR 500, was substituted for the TEFZEL 210.

Each of these blends were dried and extruded by the process of melt extrusion at elevated temperatures and pressures to produce monofilaments having diameters of 23.6 mils. The knot tenacity of each monofilament was determined and reported hereinbelow.

Table I is a comparison table of the knot tenacity properties of the control monofilament and two monofilaments of the present invention. All the data is based upon monofilaments of 23.6 mils in diameter.

TABLE I

| Properties | Knot Tenacity Comparison Monofilament Control | Monofilament 1 (w/ TEFZEL) | Monofilament 2 (w/ HALAR) |
|---|---|---|---|
| Diameter (mil) | 23.6 | 23.6 | 23.6 |
| Denier | 3175 | 3175 | 3175 |
| Knot Tenacity, | | | |
| Average (gpd) | 1.39 | 1.93 | 2.07 |
| Minimum (gpd) | 0.43 | 1.64 | 1.76 |
| Maximum (gpd) | 1.86 | 2.24 | 2.29 |
| Range (gpd) | 1.43 | 0.60 | 0.53 |
| Standard Deviation | 0.36 | 0.16 | 0.13 |

As shown in Table I, the control monofilament, a standard high temperature copolyester monofilament, has a known average knot tenacity of 1.39 grams per denier, a known minimum knot tenacity of 0.43 grams per denier, and a known maximum knot tenacity of 1.86 grams per denier. Furthermore, the knot tenacity range for the control monofilament is about 1.43 grams per denier. The standard deviation is 0.36.

In comparison, Monofilaments 1 and 2 exhibited an enhanced knot tenacity of 1.93 and 2.07 grams per denier, respectively. While the maximum values were higher than the value known for the control monofilament, the minimum knot tenacities were far higher at 1.64 and 1.76 grams per denier, respectively. Consequently, the relative knot tenacity range of each of the test monofilaments of the present invention was significantly narrower than the range for the control monofilament. Also the standard deviations for monofilament 1 and monofilament 2 are lower at 0.16 and 0.13, respectively, compared to the control monofilament at 0.36, indicating less knot tenacity variation. Generally, for the monofilaments of the present invention, the average knot tenacity is from about 1.0 to about 3.0 gpd; the minimum knot tenacity is from about 0.6 to about 2.0 gpd; and, the knot tenacity range is from about 0.2 to about 1.3 gpd.

These test results indicate that high temperature copolyester monofilaments prepared from a polymer blend of a copolyester resin and fluoropolymer resin exhibit enhanced knot tenacity and improved knot strength over what is currently known in the art. It is also believed that based on a study of surface angles and the various properties associated with contaminant resistance, the monofilaments also exhibit an increased resistance to soiling and surface contamination.

To further demonstrate the practice of the invention, similar tests for knot tenacity were performed on a Monofilament 3 extruded from a polymer blend of KODAR THERMX copolyester resin containing about 10 percent by weight of the fluoropolymer resin, TEFZEL 210. The polymer blend was extruded this time in the presence of 1.3 percent by weight of a hydrolytic stabilizer, namely Stabaxol 1. The results of this test are reported in Table II hereinbelow, and are compared to the knot tenacity of the control monofilament as described hereinabove. The diameter of each monofilament was 22.4×34.6 mils.

TABLE II

| Properties | Knot Tenacity Control Monofilament No TEFZEL | Monofilament 3 (w/TEFZEL and Staxabol) |
|---|---|---|
| Diameter (mil) | 22.4 × 34.6 | 22.4 × 34.6 |
| Denier | 4500 | 4660 |

TABLE II-continued

| Properties | Knot Tenacity Control Monofilament No TEFZEL | Monofilament 3 (w/TEFZEL and Staxabol) |
|---|---|---|
| Knot Tenacity, | | |
| Average (gpd) | 1.17 | 1.33 |
| Minimum (gpd) | 0.54 | 1.02 |
| Maximum (gpd) | 2.11 | 2.11 |
| Range (gpd) | 1.57 | 1.09 |
| Standard Deviation | 0.50 | 0.36 |

As shown in Table II, the monofilament with TEFZEL 210 extruded in the presence of 1.3 percent by weight of a hydrolytic stabilizer, Stabaxol 1, exhibited a higher knot tenacity and a higher minimum knot tenacity than the known knot tenacity of the control monofilament. The maximum knot tenacity values were not significantly different, and accordingly, the knot tenacity variation for Monofilament 3 was narrower than the variation for the control monofilament. The standard deviation was lower for Monofilament 3 compared to the control which demonstrated lower knot tenacity variation. Generally, for the monofilaments of the present invention which are extruded in the presence of a hydrolytic stabilizer, the average knot tenacity is from about 1.0 to about 3.0 gpd; the minimum knot tenacity is from about 0.6 to about 2.0 gpd; and, the knot tenacity range is from about 0.2 to about 1.3 gpd.

The test results indicate that the hydrolytic stabilizer does not significantly affect the knot tenacity of the monofilament of the present invention and that such a monofilament, whether prepared in the presence of such a stabilizer or not, exhibits an enhanced knot tenacity. Other considerations which may affect knot tenacity include yarn geometry, so comparisons should be made between monofilaments with comparable aspect ratios.

In conclusion, it should be clear from the foregoing examples and specification disclosure that the high temperature copolyester monofilaments of the present invention exhibit enhanced knot tenacity over the conventional high temperature copolyester monofilaments. It is to be understood that the use of stabilizing agents are not required, but may be added if desired. Moreover, the use of a stabilizing agent, whether for hydrolytic stability or for thermal stability, is not necessarily limited to the stabilizers disclosed herein and the examples have been provided merely to demonstrate practice of the invention. Those skilled in the art may readily select other stabilizing agents according to the disclosure made hereinabove.

Similarly, practice of the process of the present invention should not be limited to the use of a particular extruder, extrusion temperatures, quench temperature, draw ratio, relaxation ratio or the like that may be employed to extrude monofilament. It should be understood that accommodations for differences in equipment, the size and shape of the monofilament, and other physical characteristics of the monofilament of the present invention not relevant to this disclosure, can readily be made within the spirit of the invention.

Lastly, it should be appreciated that the monofilaments described herein have utility in woven fabric such as is useful as paper machine dryer fabric. The fabric woven from the monofilaments with enhanced knot tenacity exhibit greater fabric design flexibility, improved weavability and greater dimensional stability compared to fabrics woven from standard high temperature copolyester monofilaments.

Based upon the foregoing disclosure, it should now be apparent that the use of the monofilament and fabric described herein will carry out the objects set forth hereinabove. It is, therefore, to be understood that any variations evident fall within the scope of the claimed invention and thus, the selection of specific component elements can be determined without departing from the spirit of the invention herein disclosed and described. In particular, the monofilaments according to the present invention are not necessarily limited to those having the particular resins or stabilizing agents disclosed herein. Thus, the scope of the invention shall include all modifications and variations that may fall within the scope of the attached claims.

What is claimed is:

1. A high temperature copolyester monofilament having enhanced knot tenacity comprising:

a polymer blend, extruded in the presence of from 0 to about 5 percent by weight of a hydrolytic stabilizer, wherein said polymer blend includes from about 99 to about 75 percent by weight of a high temperature copolyester resin consisting essentially of a copolymer comprising terephthalic acid, 1,4-dimethylolcyclohexane and isophthalic acid;

from about 1 to about 25 percent by weight of a melt extruded fluoropolymer resin, to form 100 percent by weight of said blend; and from about 0.1 to about 10 percent by weight of a thermal stabilizer, with an appropriate reduction of at least one of the polymer components.

2. A monofilament, as in claim 1, wherein said polymer blend includes from about 5 to about 15 percent by weight of said fluoropolymer resin.

3. A monofilament, as in claim 1, wherein said polymer blend includes about 2.5 percent of said thermal stabilizer.

4. A monofilament, as in claim 1, wherein said hydrolytic stabilizer is a carbodiimide.

5. A monofilament, as in claim 1, wherein said fluoropolymer resin is selected from the group consisting tetrafluoroethylene-ethylene copolymer and chlorotrifluoroethylene-ethylene copolymer.

6. A monofilament, as in claim 1, exhibiting an average knot tenacity of from about 1.0 gpd to about 3.0 gpd.

7. A monofilament, as in claim 1, exhibiting a minimum knot tenacity of from about 0.6 gpd to about 2.0 gpd.

8. A monofilament, as in claim 1, exhibiting a knot tenacity range of from about 0.2 gpd to about 1.3 gpd.

9. A paper machine dryer fabric comprising:

a plurality of woven high temperature copolyester monofilaments having enhanced knot tenacity;

said monofilaments comprising a polymer blend, extruded in the presence of from 0 to about 5 percent by weight of a hydrolytic stabilizer, said polymer blend comprising from about 99 to about 75 percent by weight of a high temperature copolyester resin consisting essentially of a copolymer comprising terephthalic acid, 1,4-dimethylolcyclohexane and isophthalic acid;

from about 1 to about 25 percent by weight of a melt extruded fluoropolymer resin, to form 100 percent by weight of said blend; and from about 0.1 to about 10 percent by weight of a thermal stabilizer, with an appropriate reduction of at least one of the polymer components.

10. A fabric, as in claim 9, wherein said polymer blend comprises from about 5 to about 15 percent by weight of said fluoropolymer resin.

11. A fabric, as in claim 9, wherein said polymer blend includes about 2.5 percent of said thermal stabilizer.

12. A fabric, as in claim 9, comprising about 1 percent by weight of said hydrolytic stabilizer.

13. A fabric, as in claim 9, wherein said fluoropolymer resin is selected from the group consisting tetrafluoroethylene-ethylene copolymer and chlorotrifluoro-ethylene-ethylene copolymer.

14. A fabric, as in claim 9 wherein said monofilaments exhibit an average knot tenacity of from about 1.0 gpd to about 3.0 gpd.

15. A fabric, as in claim 9 wherein said monofilaments exhibit a minimum knot tenacity of from about 0.6 gpd to about 2.0 gpd.

16. A fabric, as in claim 9 wherein said monofilaments exhibit a knot tenacity range of from about 0.2 gpd to about 1.3 gpd.

* * * * *